United States Patent [19]

Yamashita et al.

[11] Patent Number: 4,806,462

[45] Date of Patent: Feb. 21, 1989

[54] SILVER HALIDE PHOTOGRAPHIC MATERIAL COMPRISING DOPED DIVALENT METAL

[75] Inventors: Seiji Yamashita; Naoto Ohshima; Shunji Takada, all of Kanagawa, Japan

[73] Assignee: Fuji Photo Film Co., Ltd., Kanagawa, Japan

[21] Appl. No.: 44,857

[22] Filed: May 1, 1987

[30] Foreign Application Priority Data

May 2, 1986 [JP] Japan ..... 61-102884

[51] Int. Cl.[4] ..... G03C 1/06

[52] U.S. Cl. ..... 430/604; 430/605

[58] Field of Search ..... 430/604, 605

[56] References Cited

U.S. PATENT DOCUMENTS

| | | | |
|---|---|---|---|
| 3,271,157 | 9/1966 | McBride | 430/604 |
| 3,447,927 | 6/1969 | Bacon et al. | 430/616 |
| 3,531,291 | 9/1970 | Bacon | 430/605 |
| 3,923,513 | 12/1975 | Evans | 430/217 |
| 3,979,213 | 9/1976 | Gilman, Jr. et al. | 430/604 |
| 4,269,927 | 5/1981 | Atwell | 430/604 |
| 4,431,730 | 2/1984 | Urabe et al. | 430/604 |
| 4,581,328 | 4/1986 | Matsuyama | 430/604 |
| 4,639,416 | 1/1987 | Yoshida et al. | 430/604 |
| 4,643,965 | 2/1987 | Kubota et al. | 430/604 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A silver halide photographic material is disclosed, comprising a support having thereon at least one photographic silver halide emulsion layer containing silver halide grains dispersed in a dispersing medium, wherein in said silver halide grains, a total weight of the portion where at least one polyvalent metal ion is doped in an amount of not less than $1\times10^{-4}$ mol per mol of the doped silver halide, is at least 10% based on the total weight of said silver halide grains.

13 Claims, No Drawings

SILVER HALIDE PHOTOGRAPHIC MATERIAL COMPRISING DOPED DIVALENT METAL

FIELD OF THE INVENTION

This invention relates to a silver halide photographic material and, more particularly, to a silver halide photographic material including an emulsion comprising silver halide grains having novel structure and composition.

BACKGROUND OF THE INVENTION

With the recent trends to reduction in size of color negative films and to diversity of photographing conditions, it has been strongly desired to develop films having higher sensitivity and broader latitude of exposure. Under these circumstances, silver halide emulsions to be used have been required to satisfy certain basic performance requirements, i.e., high sensitivity, low fog, and fine graininess. Assurance of these performances makes an important contribution to development of not only color negative films, but also all kinds of silver halide light-sensitive materials. In an attempt to prepare a silver halide emulsion exhibiting high sensitivity and fine graininess, it is desirable to reduce inefficiency involved in the photo-sensitization step and to heighten quantum sensitivity. Possible factors of inefficiency relating to quantum sensitivity include rebinding, latent image dispersion and competitive electron traps due to structural defects. Attempts to use a polyvalent metal compound in silver halide emulsions have hitherto been made. For example, *Research Disclosure,* Vol. 176, RD No. 17643 (December, 1978) describes use of gold, platinum, palladium, iridium, osmium, rhenium, etc., as a chemical sensitizer. *Research Disclosure,* Vol. 184, RD No. 18431 (August, 1979) teaches that use of copper, thallium, cadmium, rhodium, tungsten, thorium or iridium during precipitation of silver halide grains brings about sensitization for X-ray photography. Emulsions to be used for light development type light-sensitive materials preferably have high internal sensitivity and low surface sensitivity, and they sometimes contain $Cd^{2+}$, $Pb^{2+}$, $Cu^{2+}$ or a trivalent metal in order to increase internal defects to make electron traps as described in Nippon Shashin Gakkai (ed.), *Shashin Kogaku no Kiso,* p. 545, Corona (1978). *Research Disclosure,* Vol. 176, RD No. 17643 (December, 1978) discloses that direct print-out-emulsions are prepared in the presence of lead, copper, cadmium, bismuth, magnesium, rhodium, or iridium. U.S. Pat. No. 3,923,513 suggests that internal latent image type emulsions are prepared by doping with a polyvalent metal ion and that divalent ions, e.g., lead, trivalent ions, e.g., antimony, bismuth, arsenic, gold, iridium, rhodium, etc., and tetravalent ions, e.g., platinum, osmium, iridium, etc., are useful to that effect. As can be seen from these reports, polyvalent metal ion-doped emulsions are generally employed for the purpose of increasing internal sensitivity, and the polyvalent metal ions are considered to increase internal defects or to form electron traps. Therefore, in ordinary high sensitivity emulsions whose photosensitive nuclei are intentionally formed by the use of sulfur sensitizers or gold sensitizers, it is generally regarded as unfavorable from the viewpoint of quantum sensitivity to dope with a polyvalent metal ion since such causes introduction of competitive centers. For example, if emulsion grains whose surface has been chemically sensitized are doped with $Rh^{3+}$, a typical polyvalent metal ion, it is well known in T. Tani, *J. Chem. Soc. Japan,* 1222 (1972) and 1975 (1972), and D. M. Samoylovitch, J. V. Ardasheu, *Photogr. Sci. Engineer,* Vol. 17, No. 3, pp. 351–353 (1973) that $Rh^{3+}$ acts as an electron trap center, thereby tending to cause desensitization and high contrast. Such polyvalent metal ion doping has been practically utilized in light-sensitive materials for printing that require high contrast. Iridium, another typical example of polyvalent metal ions, is specific. When silver halide grains are formed in the presence of iridium in an amount of from $1\times10^{-8}$ to $1\times10^{-5}$ mol per mol of silver, improvement of sensitivity or improvement of high intensity reciprocity law failure can be obtained even in emulsions whose surface has been chemically sensitized, as described in Japanese patent publication Nos. 4935/68 and 32738/70 and Japanese patent application (OPI) Nos. 221839/83 AND 152438/84 (the term "OPI" as used herein refers to a "published unexamined Japanese patent application"). However, these reports also indicate that the amount of iridium to be added preferably ranges from $1\times10^{-7}$ to $1\times10^{-6}$ mol per mol of silver, while amounts of $1\times10^{-5}$ mol or more are not practical since such cause serious reduction in sensitivity without bringing about overall improvements in photographic characteristics. Accordingly, it has not been practically studies to increase sensitivity of emulsions by addition of polyvalent metal ions in large amounts of $1\times10^{-4}$ mol or more.

Typical divalent metal ions include $Cd^{2+}$, $Pb^{2+}$, etc. Examples of applying a large quantity of such a divalent metal compound at the time of grain formation have been reported. For example, it was reported by Wyrsch, *International Congress of Photographic Science* (1978) that addition of $1\times10^{-1}$ mol/mol Ag of $Cd(NO_3)_2$ during the preparation of an AgCl emulsion only results in doping of not more than $1\times10^{-6}$ mol/mol Ag. It was also reported by Hoyen, Journal of Applied Physics, Vol. 47, p. 3784 (1976) that addition of a large amount of $Pb(NO_3)_2$ during the preparation of an AgBr emulsion only results in doping of a very small proportion. As is apparent from these reports, it is known to dope silver halide emulsion grains with a small amount of a divalent metal ion, e.g., $Pb^{2+}$ or $Cd^{2+}$, e.g., the phrase "a small amount of a divalent metal ion" means an amount that when 0.3 mol/mol Ag of $Pb(NO_3)_2$ was added, $6.1\times10^{-5}$ mol/mol Ag of $Pb^{++}$ was doped, whereas a technique for doping $1\times10^{-4}$ mol/mol Ag or more of an impurity has been unknown. That is, there has been virtually no apparent consideration in the art with respect to photographic sensitivity of emulsions doped with a large amount of a divalent metal, particularly highly sensitive emulsions that have been subjected to sulfur sensitization or gold sensitization.

SUMMARY OF THE INVENTION

One object of this invention is to provide a photographic light-sensitive material comprising a silver halide emulsion having high sensitivity, low fog, and excellent graininess.

Another object of this invention is to provide a photographic light-sensitive material comprising a silver halide emulsion which exhibits high sensitivity under a broad range of exposure conditions.

As a result of extensive investigations, it has now been found that the above objects can be accomplished by a silver halide photographic material comprising a support having thereon at least one photographic silver halid emulsion layer containing silver halide grains dispersed in a dispersing medium, wherein in said silver halide grains, a total weight of the portion where at least one polyvalent metal ion is doped in an amount of not less than $1\times10^{-4}$ mol per mol of the doped silver halide is at least 10% based on the total weight of said silver halide grains.

DETAILED DESCRIPTION OF THE INVENTION

Closer investigations will be required to fully elucidate the mechanism of effects produced by the present invention, but it is believed that the Frenkel equilibrium within the silver halide grains is deviated upon doping with a large amount of a polyvalent metal ion. In conventional light-sensitive silver halide grains, the concentration of mobile silver ions called interstitial silver ions is higher than the number of silver ion vacancies. In accordance with theories of photographic light sensitivity, such as Gurney-Mott mechanism, Hamilton mechanism, etc., as described in T. H. James (ed.), *The Theory of the Photographic Process,* 4th Ed., Macmillan (1977), mobile silver ions have been considered essential for photosensitivity of silver halide.

When silver halide crystals are doped with a polyvalent metal ion, the interstitial silver ion concentration decreases, while the silver ion vacancy concentration that is in equilibrium with the interstitial silver ion increases. In the case of large crystals, upon doping with an impurity in an amount of about $1\times10^{-6}$ mol per mol of the doped silver halide, the number of silver ion vacancies surpasses that of the interstitial silver ions, whereby the ionic conductance through crystals comes under the government of the silver ion vacancy, as described in F. C. Brown, *The Physics of Solids,* W. A. Benjamin (1967). However, it is known that silver halide crystallites to be used in photographic light-sensitive materials have a large number of interstitial silver ions due to surface effects. It is reported, e.g., in S. Takada, *Photographic Science and Engineering,* Vol. 18, p. 500 (1974), that silver bromide emulsion grains typically show an interstitial silver ion concentration higher than a silver ion vacancy concentration by about two orders of magnitude. There are very few examples of silver halide crystallites governed by silver ion vacancy except for AgCl doped with about $1\times10^{-5}$ mol of $Cd^{2+}$ as reported by Hoyen, Ehrlich, and Briggs, *The International East-West Symposium on the Factors Influencing Photographic Sensitivity,* (1984) or the above-recited literature of S. Takada. Since silver bromide or silver iodobromide used in highly sensitive emulsions has a high interstitial silver ion concentration, it would appear that a large amount of a polyvalent metal ion must be doped therein in order to have the ionic conductance governed by silver ion vacancy.

The method for determining interstitial silver ion concentrations and silver ion vacancy concentrations of silver halide emulsion grains includes measurement of ionic conductance. In the case of emulsion grains, a dielectric loss method hs been developed for this purpose (see T. H. James (ed.), *The Theory of the Photographic Process,* 4th Ed., p. 118, Macmillan (1977). This method is well known in the art and comprises measuring frequency characteristics of impedance in a system of silver halide grains dispersed in an insulating medium, e.g., gelatin. In order to obtain information or ionic conductance inside the grains, such measurement is preferably conducted after an adsorptive substance, such as 1-phenyl-5-mercaptotetrazole, widely employed as an antifoggant, is sufficiently adsorbed onto the surface of the grains in order to offset the surface effect.

For the purpose of doping a large amount of a polyvalent metal ion according to the present invention, a salt of the polyvalent metal ion should be present during formation of silver halide grains. Examples of usable polyvalent metal include Mg, Ca, Sr, Ba, Al, Sc, Y, La, Cr, Mn, Fe, Co, Ni, Cu, Zn, Ga, Ru, Rh, Pd, OS, Ir, Pt, Cd, Hg, Tl, In, Sn, Pb, Bi, etc. These polyvalent metals can be added in the form of a salt capable of being dissolved in the system for grain formation, such as ammonium salt, an acetate, a nitrate, a sulfate, a phosphate, a hydroxide, etc. Specific examples of such a salt include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_4RhCl_6$, etc. These polyvalent metal compounds may be added either individually or in combination of two or more thereof. In the latter case, they are used in a total ion concentration of not less than $1\times10^{-4}$ mole per mol of the doped silver halide (hereinafter referred to as an "AgX").

Doping of the polyvalent metal ion sometimes brings about effects other than the increase in silver ion vacancy concentration. Those metal ions which form a deep electron trap, such as Rh, compete with latent image formation and are not preferred from the standpoint of increasing sensitivity. In the case where such a polyvalent metal ion is doped, it is necessary to take additional measures so that sensitivity specs may sufficiently meet competition with the electron traps due to the metal ions. Further, when polyvalent metal ions which suppress development progress are used, the conditions for development should be selected appropriately.

Since platinum group metal ions, i.e., Ru, Rh, Pd, Os, Ir, and Pt, have a strong property with respect to supplying electron traps, polyvalent metal ions other than the platinum group metal ions are preferred.

Preferred of the polyvalent metal ions are divalent metal ions. More preferred among them are $Pb^{2+}$, $Fe^{2+}$, and $Cd^{2+}$, with $Pb^{2+}$ being the most preferred.

The polyvalent metal compound is preferably added in the form of a solution in water or an appropriate solvent, such as methanol, acetone, and the like. In order to stabilize the solution, an aqueous solution of a hydrogen halide, e.g., hydrogen chloride, hydrogen bromide, etc., or an alkali halide, e.g., potassium chloride, sodium chloride, potassium bromide, sodium bromide, etc., can be added. If desired, an acid or an alkali metal may be added. The polyvalent metal compound may be added to a reaction vessel either before grain formation or during grain formation. It may be added to an aqueous solution of a water-soluble silver salt, e.g., silver nitrate, etc., or an alkali halide, e.g., sodium chloride potassium bromide, potassium iodide, etc., and the resulting solution may be added continuously during grain formation. Further, a solution of the polyvalent metal compound may be prepared separately from the water-soluble silver salt or alkali halide and be added continuously at an appropriate stage during grain formation. These methods of addition may be adopted in combinations to advantage.

It is not sufficient for the polyvalent metal compound which should be doped on a silver halide grain to be present during grain formation in an amount of not less than $1\times10^{-4}$ mol per mol of silver halide. In fact, in the literature descriptions appear wherein grain formation is carried out in the preence of not less than 10 mol % of a polyvalent metal compound. For example, D. Wyrsch, *International Congress of Photographic Science* (1978) reports doping of a silver chloride emulsion with $Cd^{2+}$, and H. A. Hoyen, *Journal of Applied Physics*, Vol. 47, p. 3784 (1976) describes doping of a silver bromide emulsion with $Pb^{2+}$. According to these reports, however, the polyvalent metal ions cannot be doped inside the grains in a large amount. Thus, it has been very difficult to form grains doped with a large amount of a polyvalent metal ion. Therefore, almost no literature can be found concerning photographic properties of emulsions containing such grains, and it has been predicted that grains having a very low concentration of interstitial silver ions that are essential for photosensitivity are disadvantageous according to the photographic sensitivity theories currently accepted in the art. It is, therfore, utterly unanticipated and surprising that chemically sensitized emulsions doped with a large amount of a polyvalent metal ions, i.e., according to the present invention, exhibit favorable photographic characteristics of high sensitivity and less reciprocity law failure.

Achievement of doping a large amount of a polyvalent metal ion requires not only the presence of a polyvalent metal compound during grain formation, but also proper selection of conditions for grain formation. To this effect, suitable grain formation conditions should be decided for the respective polyvalent metal ion through trial and error. That is, great care should be directed to selection of conditions, such as the temperature for grain formation, the kind and concentration of protective colloids in the reaction system, pH and pAg in the reaction system, the method of addition and rate of addition of the water-soluble silver salt or alkali halide, the kind and concentration of a silver halide solvent, the amount of the polyvalent metal ion, the kind of the ligand for the polyvalent metal ion, and the like.

For example, in the case of doping a large amount of $Pb^{2+}$, $Fe^{2+}$, $Cd^{2+}$, etc., the grain formation reaction is preferably carried out at a relatively low temperature (e.g., from 30° to 50° C.) using not less than 5 ml/l of a silver halide solvent (e.g., ammonia) with the added amounts of the water-soluble silver salt aqueous solution and alkali halide aqueous solution being increased so that the growth rate of silver halide reaches near the critical rate. Preferred methods for increasing the added amounts of the water-soluble silver salt aqueous solution and the alkali halide aqueous solution include the method of increasing the rate of addition as described in U.S. Pat. No. 3,650,757 and the method of increasing the concentration to be added as described in U.S. Pat. Nos. 4,242,445 and 4,301,241.

The polyvalent metal ion is preferably doped in such an amount that at least 10% by weight, and more preferably at least 30% by weight, of the total weight of silver halide grains has the concentration of at least $3\times10^{-4}$ mol of a polyvalent metal per mol of the doped silver halide.

The polyvalent cation impurities doped into the silver halide grains can be quantitatively analyzed by atomic absorption spectroscopy and inductively coupled plasma (ICP) emission spectroscopic analysis, and the like. In general, ICP emission spectroscopic analysis is utilized for analyzing ions having high atomization temperature, such as Ir, and atomic absorption spectroscopy is utilized for analyzing ions such as $Pb^{2+}$, $Cd^{2+}$, $Fe^{2+}$, etc. Samples to be analyzed are usually prepared by centrifuging a silver halide emulsion together with water to separate into gelatin and silver halide grains, and then dissolving the grains in an ammonium thiosulfate solution. When it is believed that the polyvalent cation impurity is present outside of the grains in the form of a sparingly water-soluble salt, a solvent capable of dissolving such a salt, such as an acid, should be added to the emulsion together with water.

For the preparation of a calibration curve, a standard solution can be prepared from an emulsion containing no impurity, and a known amount of an impurity is finally added to the solution.

It is believed that portions under the government of silver ion vacancy can be formed by doping with a polyvalent metal ion to produce the effects of the present invention. The term "under the government of silver ion vacancy" as used herein means that conductance attributable to silver ion vacancies ($\sigma_v=n_v\cdot e\cdot\mu_v$) is greater than that attributable to interstitial silver ions ($\sigma_i=n_i\cdot e\cdot\mu_i$), wherein $n_i$ represents an interstitial silver ion concentration; $\mu_i$ represents mobility of interstitial silver ions; $n_v$ represents a silver ion vacancy concentration; $\mu_v$ represents mobility of silver ion vacancy; and e represents an elementary charge. Whether conduction in silver halide grains is governed by interstitial silver ion or silver ion vacancy can be judged by determining ionic conductance by the aforesaid dielectric loss method. It is assumed that the amount to be doped which is necessary for the silver halide grains to be governed by silver ion vacancy might be varied depending on the factors of emulsion grains, such as halogen composition, grain size, crystal habit, etc., or properties of the polyvalent metal ion to be doped. Nevertheless, the amount of the polyvalent metal ion to be doped of not less than $1\times10^{-4}$ mol/mol AgX in accordance with the present invention has been confirmed to be sufficient for many emulsions to be governed by silver ion vacancy. The amount to be doped is preferably not less than $2\times10^{-4}$ mol/mol AgX, and more preferably not less than $3\times10^{-3}$ mol/mol AgX.

When a large amount of a polyvalent metal ion is doped to cause the emulsion to be governed by silver ion vacancy, possible effects that may be produced include an effect to prevent rebinding as proposed by Malinowski, an effect to reduce internal latent image formation due to reduction in interstitial silver ion concentration in the inside of grains, an effect of charge separation due to control on the space charge potential present in the inside of grains, and the like. The type of inefficiency is believed to be inherent in the respective emulsion, varying depending on the process employed for the preparation of emulsion grains and the composition, form, and internal structure of grains. Therefore, it is preferable to distribute the polyvalent metal ions uniformly through the whole grains in some cases, or nonuniformly in other cases. The latter is applied to a core-shell structure, a multilayer structure, an epitaxial structure, and the like. In the case of the core-shell structure, the doping concentration may be higher in the core than in the outer shell, or vice versa. In the case of the multilayer structure, the doping concentration may be increasing from the inner layer toward the outer layer or vice versa, or a layer of higher concentration and a layer of lower concentration may alternate with each other. In the case of the epitaxial structure, the host portion may have a higher doping concentration, or the guest portion may have a higher doping concentration. Preferred nonuniform distribution systems of the polyvalent metal ion throughout the grains cannot be generalized because of their dependence on characteristics of grains, such as whether they are twinned or normal crystals, the halogen composition and structure thereof, or crystal habit, whether they are of surface latent image type or internal latent image type, the size or form of grains, and the like. Irrespective of the distribution system, the portion under the government of silver ion vacancy, i.e., where a polyvalent metal ion is doped in an amount of not less than $1\times10^{-4}$ mol per mol of the doped silver halide, should have a proportion of at least 10%, preferably at least 30%, and more preferably at least 50%, based on the weight of the total silver halide grains. Those grains doped with not less than $1\times10^{-4}$ mol/mol AgX of a polyvalent metal ion and those grains doped with not more than $1\times10^{-4}$ mol/mol AgX may be copresent, but it is required for the former to have a proportion of at least 10%, preferably at least 30%, and more preferably at least 50%, based on the weight of the total silver halide grains.

Further, the silver halide grains in the emulsion which can be used in the present invention preferably have substantially identical composition and identical structure, and comprise a silver halide grain wherein in one silver halide grain, a weight of the portion where at least one polyvalent metal ion is doped in an amount of not less than $1\times10^{-4}$ mol per mol of the silver halide is at least 10% based on the weight of one silver halide grain.

The silver halide which can be used in the photographic emulsions may be any of silver bromide, silver iodobromide, silver iodochlorobromide, silver chlorobromide, and silver chloride. Preferred are silver iodobormide containing not more than 30 mol % of silver iodide, silver bromide, and silver chlorobromide.

The silver halide grains in the emulsion may have a regular crystal form, such as cubic, octahedral, and tetradecahedral forms, or an irregular crystal form, such as a spherical form, or may have a crystal defect, such as a twinning plane. The grains may have a composite form of these various crystal forms.

The grains may have a broad size range of from fine grains of not greater than 0.1 μm to giant grains reaching 10 μm in projected area diameter. The silver halide emulsion may be monodispersed with narrow size distribution, or polydispersed with broad size distribution.

The photographic emulsions to be used in the present invention can be prepared by any known processes as described, e.g., in P. Glafkides, *Chimie et Physique Photographique,* Paul Montel (1967); G. F. Duffin, *Photographic Emulsion Chemistry,* Focal Press (1966); V. L. Zelikman et al., *Making and Coating Photographic Emulsion,* Focal Press (1964); etc. In some detail, the emulsion can be prepared by any of the acid process, the neutral process, the ammonia process, and the like. The reaction between a soluble silver salt and a soluble halogen salt can be carried out by a single jet method, a double jet method, a combination thereof, and the like. A so-called reverse mixing method in which grains are formed in the presence of excess silver ions, or a so-called controlled double jet method in which a pAg value of a liquid phase where grains are formed is maintained constant may also be employed. According to the controlled double jet method, a silver halide emulsion having a regular crystal form and a nearly uniform grain size can be obtained.

Two or more silver halide emulsions separately prepared may be used as a mixture.

Emulsions comprising the above-described silver halide grains having a regular crystal form can be obtained by controlling pAg and pH values of the reaction system. For details, see, e.g., *Photographic Science and Engineering,* Vol. 6, pp. 159–165 (1962), *Journal of Photographic Science,* Vol. 12, pp. 242–251 (1964), U.S. Pat. No. 3,655,394 and British Patent No. 1,413,748.

Tabular grains having an aspect ratio of 5 or more (i.e., 5/1 or more) may also be employed in the invention. The tabular grains can be prepared easily by known processes described, e.g., in Cleve, *Photographic Theory and Practice,* p. 131 (1930), Gutoff, *Photographic Science and Egineering,* Vol. 14, pp. 248–257 (1970), U.S. Pat. Nos. 4,434,226, 4,414,310, 4,433,048 and 4,439,520, British Pat. No. 2,112,157, etc. Use of the tabular grains is advantageous in that an enhanced covering power and an increased efficiency of color sensitization by sensitizing dyes can be obtained. For details, see the above-cited U.S. Pat. No. 4,434,226, etc.

The silver halide crystals may be homogeneous throughout the individual grains or may have a heterogeneous structure comprising a core and an outer shell having different halogen compositions, or may have a layered structure. These emulsion grains are disclosed in British Pat. No. 1,027,146, U.S. Pat. Nos. 3,505,068 and 4,444,877, Japanese patent application (OPI) No. 143331/85, etc. The grains may also have fused thereto a silver halide of different composition by epitaxial growth or a compound other than silver halide, e.g., silver thiocyanate, lead oxide, etc. A mixture of grains having various crystal forms may be used.

Silver halide solvents are useful for acceleration of ripening. For example, it is known that ripening can be accelerated by adding an excess halogen ion to the reaction system. Therefore, it is apparent that ripening may be accelerated simply by introducing a halogen salt solution to the reaction system. These and other ripening agents may be introduced all at once to a dispersing medium for the reaction prior to addition of a silver salt and a halide, or may be introduced to the system together with one or more of the halide, the silver salt, and a peptizer. The ripening agent may also be added separately to the reaction system at the stage of adding the halide and silver salt.

Useful ripening agents other than halogen ions include ammonia, amine compounds, and thiocyanates (e.g., alkali metal thiocyanates, especially sodium or potassium thiocyanate, and ammonium thiocyanate). The silver halide emulsion can also be subjected to internal reduction sensitization in the course of precipitation of grain as taught in Japanese Patent Publication No. 1410/83 and Moisar et al., *Journal of Photographic Science,* Vol. 25, pp. 19–27 (1977).

In the present invention, it is very important to subject the emulsion to chemical sensitization, such as sulfur sensitization and gold sensitization. As will be shown in Example 4 below, the grains doped with $1\times10^{-4}$ mol/mol AgZ or more of a polyvalent metal ion show no characteristic photographic properties in their primitive state, and the effects of doping are significantly manifested after they are chemically sensitized. The site to be chemically sensitized varies depending on the composition, structure or shapes of emulsion grains or the end use of the emulsion. That is, sensitivity nuclei may be formed by chemical sensitization in the interior of grains, or a little beneath the surface, or on the surface of grains. The effects of the present invention can be exerted in any of these cases, but are particularly conspicuous in the case where the sensitivity nuclei are formed in the vicinity of the grain surface, i.e., in surface latent image type emulsions as compared with internal latent image type emulsions.

The chemical sensitization can be carried out by using active gelatin as described in T.H. James, *The Theory of the Photographic Process,* 4th Ed., pp. 67–76, Macmillan (1977). It may also be effected by using sulfur, selenium, tellurium, gold, platinum, palladium, iridium, or a combination thereof, under conditions of pAg of from 5 to 10, a pH of from 5 to 8, and a temperature of from 30° to 80° C. as described in *Research Disclosure,* Vol. 120, RD No. 12008 (April, 1974), ibid., Vol. 134, RD No. 13452 (June, 1975), U.S. Pat. Nos. 2,642,361, 3,297,446, 3,772,031, 3,857,711, 3,901,714, 4,266,018 and 3,904,415, and British Pat. No. 1,315,755. Most preferably, chemical sensitization can be performed in the pesence of a combination of a gold compound and a thiocyanate compound, or in the presence of a sulfur-containing compound as disclosed in U.S. Pat. Nos. 3,857,711, 4,266,018, and 4,054,457 or other sulfur-containing compounds, such as Hypo (sodium thiosulfate), thiourea compounds, rhodanine compounds, etc. The chemical sensitization may be effected in the copresence of a chemical sensitization aid. Usable chemical sensitization aids include compounds known to increase sensitivity while inhibiting fog in the process of chemical sensitization, such as azaindenes, azapyridazines, azapyrimidines, and the like. Examples of chemical sensitization aid modifiers are described in U.S. Pat. Nos. 2,131,038, 3,411,914 and 3,554,757, Japanese patent application (OPI) No. 126526/83, and the above-cited literature of Duffin, pp. 138–143. In addition to or in place of the chemical sensitization, the emulsion may be subjected to reduction sensitization by, for example, using hydrogen as described in U.S. Pat. Nos. 3,891,446 and 3,984,249; or by using a reducing agent, e.g., stannous chloride, thiourea dioxide, polyamines, etc., as described in U.S. Pat. Nos. 2,518,698, 2,743,182, and 2,743,183; or by treating at a low pAg (e.g., less than 5) and/or a high pH (e.g., more than 8). The method of chemical sensitization described in U.S. Pat. Nos. 3,917,485 and 3,966,476 may also be employed to improve color sensitivity. The method of chemical sensitization described in Japanese patent application (OPI) No. 93447/86 is particularly effective when combined with the emulsion of the present invention.

In the light-sensitive materials of the present invention, various color couplers can be used, and specific examples thereof are described in patents cited in *Research Disclosure,* Vol. 176, RD No. 17643 (December, 1978), VII-C to G.

Yellow couplers which can be used typically include acylacetamide couplers which have a ballast group and are thereby hydrophobic. 2-Equivalent yellow couplers are preferably used. Such couplers typically include those capable of releasing a dye moiety at an oxygen atom and those capable of releasing a dye moiety at a nitrogen atom. Particularly preferred of these are α-pivaloylacetanilide couplers and α-benzoylacetanilide couplers.

Magenta couplers to be used typically include indazolone couplers, cyanoacetyl couplers, 5-pyrazolone couplers, and pyrazoloazole couplers which have a ballast group and are thereby hydrophobic, with the last two couplers being preferred. Of the 5-pyrazolone couplers, those substituted with an arylamino group or an acylamino group at the 3-position thereof are more preferred.

2-Equivalent 5-pyrazolone couplers preferably have a nitrogen release group or an arylthio group as a releasable group. 5-Pyrazolone couplers having the ballast group described in European Pat. No. 73,636 provide high color densities. Examples of the pyrazoloazole couplers include pyrazolobenzimidazoles, and preferably pyrazolo[5,1-c][1,2,4]triazoles, pyrazolotetrazoles described in *Research Disclosure,* Vol. 242, RD No. 24220 (June, 1984) and Japanese patent application (OPI) No. 33552/85, and pyrazolopyrazoles described in ibid., Vol. 242, RD No. 24230 (June, 1984) and Japanese patent application (OPI) No. 43659/85. Imidazolo[1,2-b]-pyrazoles are preferred, with pyrazolo[1,5-b][1,2,4]-triazoles being particularly preferred.

Cyan couplers to be used typically include naphthol couplers described in U.S. Pat. No. 2,474,293, and preferably 2-equivalent naphthol couplers of oxygen release type as described in U.S. Pat. Nos. 4,052,212, 4,146,396, 4,228,233 and 4,296,200; phenol couplers as described in U.S. Pat. Nos. 2,369,929, 2,801,171, 2,772,162 and 2,895,826.

Cyan couplers capable of forming cyan dyes that are fast to moisture and heat are advantageously used in the present invention. Such couplers include phenol cyan couplers having an alkyl group other than an ethyl group at the m-position of the phenol nucleus and phenol cyan couplers having a phenylureido group at the 2-position and an acylamino group at the 5-position. 2,5-Diacylamino-substituted phenol couplers and naphthol couplers having a sulfonamido group, an amido group, etc., at the 5-position are also preferred.

In addition to the above-described couplers, colored couplers, couplers producing dyes having moderate diffusibility, dye forming couplers in a polymerized form, and couplers capable of releasing a development inhibitor (DIR couplers), and the like may also be used. The DIR couplers preferably include those described in Japanese patent application (OPI) Nos. 151944/82 and 154234/82.

The present invention can be applied to various kinds of color and black-and-white light-sensitive materials, such as color negative films for general use or movies, color reversal films for slides or movies (containing no couplers in some cases), color papers, color positive films for movies, color reversal papers, heat-developable light-sensitive materials (U.S. Pat. No. 4,500,626, Japanese patent application (OPI) Nos. 133449/85, 218443/84 and 238056/86 can be referred to for details), color light-sensitive materials using a silver dye bleach process, light-sensitive materials for photomechanical process (e.g., lith films, scanner films, etc.), light-sensitive materials for X-ray photography (for direct or indirect photography for medical or industrial use, etc.), black-and-white negative films for photographing, black-and-white photographic paper, light-sensitive materials (for computer output microfilms, microfilms, etc.), color diffusion transfer light-sensitive materials (DTR), silver salt diffusion transfer light-sensitive materials, print-out light-sensitive materials, and so on.

The light-sensitive materials according to the present invention can contain various photographic additives other than the above-recited compounds. Details for these additives are described, e.g., in *Research Disclosure,* Vol. 176, RD No. 17643 (December, 1978) and ibid., Vol. 187, RD No. 18716 (November, 1979) as tabulated below.

| Kind of Additives | RD No. 17643 | RD No. 18716 |
|---|---|---|
| 1. Chemical Sensitizers | p. 23 | p. 648, right column |
| 2. Sensitivity Increasing Agents | — | p. 648, right column |
| 3. Spectral Sensitizers and Supersensitizers | pp. 23–24 | p. 648, right column to p. 649, right column |
| 4. Brightening Agents | p. 24 | — |
| 5. Antifoggants and Stabilizers | pp. 24–25 | p. 649, right column |
| 6. Light Absorbers, Filter Dyes and Ultraviolet Absorbents | pp. 25–26 | p. 649, right column to p. 650, left column |
| 7. Antistaining Agents | p. 25, right column | p. 650, left column to right column |
| 8. Dye Image Stabilizers | p. 25 | — |
| 9. Hardeners | p. 26 | p. 651, left column |
| 10. Binders | p. 26 | p. 651, left column |
| 11. Plasticizers and Lubricants | p. 27 | p. 650, right column |
| 12. Coating Aids and Surfactants | pp. 26–27 | p. 650, right column |
| 13. Antistatic Agents | p. 27 | p. 650, right column |

The light-sensitive materials according to the present invention can be processed by conventional methods with conventional processing solutions. The processing temperature is usually selected from the range of from 18° C. to 50° C., but temperatures out of this range may also be employed. Any photographic processing, whether for the formation of a silver image (black-and-white photographic processing) or for the formation of a dye image (color photographic processing), can be used depending on the end use of the light-sensitive material.

Black-and-white developing solutions contain known developing agents, such as dihydroxybenzenes (e.g., hydroquinone), 3-pyrazolidones (e.g., 1-phenyl-3-pyrazolidone), aminophenols (e.g., N-methyl-p-aminophenol), etc., either alone or in combinations thereof.

Color developing solutions generally comprise an alkaline aqueous solution containng a color developing agent. The color developing agent to be used includes conventional primary aromatic amine developing agents, such as phenylenediamines (e.g., 4-amino-N,N-diethylaniliene, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

Other known developing agents as described in L. F. A. Mason, *Photographic Processing Chemistry*, pp. 226 to 228, Focal Press (1966), U.S. Pat. Nos. 2,193,015 and 2,592,364, and Japanese patent application (OPI) No. 64933/73 may also be used.

The developing solution can further contain pH buffers, such as sulfites, carbonates, borates, or phosphates, of alkali metals; development restrainers or antifoggants, such as bromides, iodides, and organic antifoggants; and the like. If desired, the developing solution can furthermore contain other additives, such as water softeners, preservatives (e.g., hydroxylamine), organic solvents (e.g., benzyl alcohol, diethylene glycol, etc.), development accelerators (e.g., polyethylene glycol, quaternary ammonium salts, amines, etc.), dye forming couplers, completing couplers, fogging agents (e.g., sodium boron hydride), auxiliary developing agents (e.g., 1-phenyl-3-pyrazolidone), viscosity-imparting agents, polycarboxylic acid chelating agents described in U.S. Pat. No. 4,083,723, antioxidants described in West German patent application (OLS) No. 2,622,950 and the like.

In color photographic processing, the light-sensitive material after color development is usually subjected to bleaching. Bleaching may be carried out simultaneously with fixing, or these two steps may be effected separately. Bleaching agents which can be used include compounds of polyvalent metals, e.g., iron (III), cobalt (III), chromium (VI), copper (II), etc., peracids, quinones, nitroso compounds, and the like. Examples of these bleaching agents include ferricyanides; bichromates; organic complex salts of iron (III) or cobalt (III), such as complex salts with aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol; and the like. Of these, potassium ferricyanide, sodium (ethylenediaminetetraacetato)iron (III), and ammonium (ethylenediaminetetraacetato)iron (III) are particularly useful. Ethylenediaminetetraacetato iron (III) complex salts are useful in either an independent bleaching bath or a bleach-fixing monobath.

The bleaching or bleach-fixing bath can contain bleaching accelerators as described in U.S. Pat. Nos. 3,042,520 and 3,241,966, and Japanese patent publication Nos. 8506/70 and 8836/70, thiol compounds as described in Japanese patent application (OPI) No. 65732/78, and other various additives.

The present invention is now illustrated in greater detail by reference to examples, but it should be understood that the present invention is not limited thereto. In these examples, all percents are by weight unless otherwise indicated.

EXAMPLE 1

(1) Preparation of Emulsion:

| | |
|---|---|
| Solution 1-A: | |
| Bone Gelatin | 20 g |
| Potassium Bromide | 0.6 g |
| Water | 1,000 ml |
| Solution 1-B: | |
| Silver Nitrate | 10 g |
| Ammonium Nitrate | 0.25 g |
| Water | 40 ml |
| Solution 1-C: | |
| Potassium Bromide | 7 g |
| Water | 50 ml |
| Solution 1-D: | |
| Silver Nitrate | 200 g |
| Water | 750 ml |
| Solution 1-E: | |
| Potassium Bromide | 170 g |
| Water | 1,100 ml |

Solution 1-A was placed in a reaction vessel and stirred at 75° C. Solutions 1-B and 1-C were added thereto simultaneously over a period of 40 seconds. To the solution were added 7.5 g of ammonium nitrate and 15 ml of 25 wt % ammonia, followed by ripening for 5 minutes. Solutions 1-D and 1-E were then added thereto at 60° C. over 100 seconds at constant flow rates while controlling the silver potential at +70mV. The resulting emulsion grains were cubic and had a mean grain size of 1.2 μm with a coefficient of variation of 13%. This emulsion was for comparison and designated as Emulsion (1).

After Solutions 1-B and 1-C were added to Solution 1-A in the same manner as above, 2 g of ammonium nitrate and 15 ml of 25 wt % ammonia were added to the solution, followed by ripening for 5 minutes. To Solution 1-D was added 1.3 g of $Pb(NO_3)_2$, and the resulting solution and Solution 1-E were added thereto at 40° C. while controlling the silver potential at +90 mV. The flow rates of these solutions were gradually elevated so that the final flow rates were four times the initial flow rates. The resulting emulsion grains were cubic and had a mean grain size of 1.1 μm with a coefficient of variation of 15%. This emulsion was designated as Emulsion (2).

After Solutions 1-B and 1-C were added to Solution 1-A in the same manner as for Emulsion (1), 4 g of ammonium nitrate and 8 ml of 25 wt % ammonia were added to the solution, followed by ripening for 10 minutes. To Solution 1-D was added 0.4 g of $Pb(NO_3)_2$, and the resulting solution and Solution 1-E were added to the mixture at 50° C. while controlling the silver potential to +70mV. The flow rates of these solutions were gradually elevated so that the final flow rates were three times the initial flow rates. The resulting grains were cubic and had a mean grain size of 1.2 μm with a coefficient of variation of 12%. This emulsion was designated as Emulsion (3).

After Solutions 1-B and 1-C were added to Solution 1-A in the same manner as for Emulsion (1), 2 g of ammonium nitrate and 4 ml of 25 wt % ammonia were added to the solution, followed by ripening for 20 minutes. To Solution 1-D was added 0.04 g of $Pb(NO_3)_2$, and the resulting solution and Solution 1-E were added to the mixture at 60° C. at constant flow rates while controlling the silver potential to +70 mV. The resulting grains were cubic and had a mean grain size of 1.3 μm with a coefficient of variation of 14%. This emulsion was designated as Emulsion (4).

After Solutions 1-B and 1-C were added to Solution 1-A in the same manner as for Emulsion (1), 2 g of ammonium nitrate and 15 ml of 25 wt % ammonia were added thereto, followed by ripening for 5 minutes. To Solution 1-D was added 0.4 g of $Pb(NO_3)_2$, and the resulting solution and Solution 1-E were added to the mixture at 40° C. while controlling the silver potential to −30 mV. The flow rates of these solutions were gradually elevated so that the final flow rates were four times the initial flow rates. The resulting grains were octahedral and had a mean grain size of 1.3 μm with a coefficient of variation of 12%. This emulsion was designated as Emulsion (5).

After Solutions 1-B and 1-C were added to Solution 1-A in the same manner as for Emulsion (1), 2 g of ammonium nitrate and 1 ml of 25 wt % ammonia were added thereto, followed by ripening for 30 mintues. To Solution 1-D was added 0.4 g of $Pb(NO_3)_2$, and the resulting solution and Solution 1-E were added to the mixture at 75° C. at constant flow rates while controlling the silver potential to +70 mV. The resulting grains were cubic and had a mean grain size of 1.1 μm with a coefficient of variation of 14%. This emulsion was designated as Emuslion (6).

(2) Determination of Doped Pb:

Each of Emulsions (1) to (6) was analyzed to determine the amount of Pb doped. After the gelatin in the emulsion was subjected to centrifugation to collect trains, water was added thereto, and centrifugal separation was repeated twice. Further, 1 N nitric acid was added thereto, and centrifugal separation was repeated twice. After thorough washing with water, the precipitate collected was dissolved in ammonium thiosulfate and subjected to atomic absorption spectroscopy to determine Pb. A calibration curve was prepared from Emulsion (1) to which a known amount of $Pb(NO_3)_2$ had been added. The results obtained are shown in Table 1 below.

TABLE 1

| Emulsion No. | Amount of $Pb^{2+}$ Added (mol/mol AgX) | Amount of $Pb^{2+}$ Doped (mol/mol AgX) |
|---|---|---|
| (1) (Comparison) | 0 | Not detected |
| (2) (Invention) | $3.3 \times 10^{-3}$ | $1.1 \times 10^{-3}$ |
| (3) (Invention) | $1 \times 10^{-3}$ | $3.5 \times 10^{-4}$ |
| (4) (Comparison) | $1 \times 10^{-4}$ | $1.5 \times 10^{-5}$ |
| (5) (Invention) | $1 \times 10^{-3}$ | $4.0 \times 10^{-4}$ |
| (6) (Comparison) | $1 \times 10^{-3}$ | $1 \times 10^{-6}$ |

It can be seen from Table 1 that Emulsions (2), (3) and (5) had been doped with a large amount of $Pb^{2+}$. These results are unanticipated from the common knowledge that an amount of $Pb^{2+}$ that can be doped is only from 1/10,000 to 1/1,000 of the amount added. Thus, the amount doped in Emulsion (6) is only about 1/1,000 of the amount added. From these considerations, it can be understood that whether $Pb^{2+}$ can be doped or not greatly depends on the conditions for grain formation.

EXAMPLE 2

| | |
|---|---|
| Solution 2-A: | |
| Bone Gelatin | 10 g |
| Potassium Bromide | 0.9 g |
| Ammonium Nitrate | 2 g |
| Water | 1,000 ml |
| Solution 2-B: | |
| Silver Nitrate | 10 g |
| Water | 40 ml |
| Solution 2-C: | |
| Potassium Bromide | 7 g |
| Water | 50 ml |
| Solution 2-D: | |
| Silver Nitrate | 200 g |
| Water | 800 ml |
| Solution 2-E: | |
| Potassium Bromide | 165 g |
| Potassium Iodide | 4.7 g |
| Water | 1,100 ml |

Solution 2-A was placed in a reaction vessel, followed by stirring at 50° C. Solutions 2-B and 2-C were added thereto simultaneously over 40 seconds. To the solution was added 15 ml of 25 wt % ammonia, followed by ripening for 15 minutes. To Solutions 2-E was added 0.78 g of potassium iridium chloride ($K_3Ircl_6$), and the resulting solution and Solution 2-D were added simultaneously to the mixture at 50° C. while controlling the silver potential to 80 mV. The flow rates of these solutions were gradually elevated so that the final flow rates were three times the initial flow rates. This emulsion was designated as Emulsion (7).

Emulsion (8) was prepared in the same manner as for Emulsion (7) except for replacing $K_3IrCl_6$ with 1.2 g of cadmium bromide ($CdBr_2$). Emulsion (9) was prepared in the same manner as for Emulsion (7) except that Solution 2-E consisted of 168 g of potassium bromide and 1,100 ml of water and that 0.63 of potassium ferrocyanide trihydrate ($K_4[Fe(CN)_6]\cdot 3H_2O$) was added to Solution 2-E. Each of Emulsions (7) to (9) comprises cubic silver iodobromide grains having a mean grain size of 0.5 μm.

A sample solution for metal ion determination was prepared from each emulsion in the same manner as in Example 1. Cd and Fe were determined by atomic absorption spectroscopy, and Ir having a high atomization temperature was determined by ICP emission spectroscopic analysis. The results obtained are shown in Table 2.

TABLE 2

| Emulsion No. | Kind of Metal | Amount of Metal Ion Added (mol/mol AgX) | Amount of Metal Ion Doped (mol/mol AgX) |
|---|---|---|---|
| (7) | Ir | $1 \times 10^{-3}$ | $7.2 \times 10^{-4}$ |
| (8) | Cd | $3 \times 10^{-3}$ | $4.5 \times 10^{-4}$ |
| (9) | Fe | $1 \times 10^{-3}$ | $4.2 \times 10^{-4}$ |

It can be seen that any of Ir, Cd and Fe can be doped in a large amount of $1\times 10^{-4}$ mol/mol AgX or more.

EXAMPLE 3

A monodispersed emulsion comprising octahedral silver iodobromide grains having a silver iodide content of 24 mol % as core grains was prepared in the presence of ammonia according to a controlled double jet method as follows. To 1,000 ml of an aqueous solution containing 3 wt % gelatin and 30 m: of 25 wt % ammonia were added 500 m: of an aqueous solution containing 100 g of silver nitrate ($AgNO_3$) and 0.39 g of $Pb(NO_3)_2$ and 500 ml of an aqueous solution containing potassium bromide (KBr) and potassium iodide (KI) at 50° C. while controlling the silver potential at 10 mV and increasing the flow rates so that the final flow rates were four times the initial flow rates.

The thus prepared emulsion was washed with water, and pure silver bromide was deposited around the core grains to form an outer shell until the core and the outer shell had the same silver content in accordance with a controlled double jet method as follows. After 5 ml of 25 wt % ammonia and 1 g of ammonium nitrate ($NH_4NO_3$) were added to the reaction mixture, 500 ml of an aqueous solution containing 100 g of silver nitrate and 0.39 g of Pb $(NO_3)_2$ and 500 ml of an aqueous solution containing potassium bromide were added thereto simultaneously at 40° C. while controlling the silver potential at −20 mV and increasing the flow rates so that the final flow rates were twice the initial flow rates. The resulting grains were octahedral and had a mean grain size of 1.2 μm. The X-ray diffraction pattern of the grains showed two peaks at diffraction angles corresponding to the lattice constants of silver iodobromide contents of about 22 mol % and about 2 mol %, respectively, indicating that these grains had a core-shell structure with a total silver iodide content of 12 mol %. This emulsion was designated as Emulsion (10).

1,000 ml of an aqueous solution containing potassium bromide and gelatin was kept at 70° C. while vigorously stirring. A silver nitrate aqueous solution and a mixed aqueous solution of potassium bromide and potassium iodide were added to the gelatin aqueous solution while maintaining pBr at 1.1 according to a double jet method. The amount of silver nitrate used up to this stage was 10 wt % of the total amount to be used. After 10 ml of 25 wt % ammonia was added to effect physical ripening, a silver nitrage aqueous solution containing $1.5\times 10^{-3}$ mol/mol AgX of $Pb(NO_3)_2$ and a mixed aqueous solution of potassium bromide and potassium iodide were added thereto at 40° C. while maintaining pBr at 1.1 in accordance with a double jet method. The flow rates of these solutions were gradually increased so that the final flow rates were three times the initial flow rates. The thus formed grains were tabular grains comprising a (111) face as a main plane and having an average diameter of 1.5 μm, a mean thickness of 0.125 μm, and an aspect ratio (mean diameter/mean thickness ratio) of 12. The grains had a mean silver iodide content of 4 mol %. The resulting emulsion was designated as Emulsion (11).

To 1,000 ml of a 3 wt % gelatin aqueous solution was added 2.3 g of sodium chloride, and 1 g of ammonium nitrate and 7 ml of 25 wt % ammonia were further added thereto. The resulting solution was kept at 65° C. while stirring, and 800 ml of an aqueous solution containing 0.58 g of $Pb(NO_3)_2$ and 150 g of silver nitrate and 800 ml of an aqueous solution containing 52.5 g of potassium bromide and 29.5 g of sodium chloride were added thereto simultaneously over a period of 2 minutes. The amount of silver nitrate used up to this stage was 10 wt % of the total amount to be used. The reaction temperature was decreased to 45° C., and the remainders of the silver nitrate aqueous solution and the alkali halide aqueous solution were added to the reaction mixture with the flow rates being gradually increased so that the final flow rates were twice the initial flow rates. The thus formed grains were cubic silver chlorobromide grains having a mean grain size of 0.8 μm and a silver chloride content of about 50 mol %. The resulting emulsion was designated as Emulsion (12).

A sample solution was prepared from each of Emulsions (10) to (12) in the same manner as in Example 1, and was determined for $Pb^{2+}$ ion by atomic absorption spectroscopy. The results obtained as shown in Table 3.

TABLE 3

| Emulsion No. | Type of Grains | Amount of $Pb^{2+}$ Added (mol/mol AgX) | Amount of $Pb^{2+}$ Doped (mol/mol AgX) |
|---|---|---|---|
| (10) | Silver iodobromide, core-shell structure | $2 \times 10^{-3}$ | $6.5 \times 10^{-4}$ |
| (11) | Silver bromide, tabular | $1.4 \times 10^{-3}$ | $3.1 \times 10^{-4}$ |
| (12) | Silver chlorobromide cubic | $2 \times 10^{-3}$ | $5.0 \times 10^{-4}$ |

EXAMPLE 4

Five monodispersed emulsions of cubic silver bromide grains having doped therein different amounts of $Pb^{2+}$ (Emulsions (13) to (17)) were prepared in the same manner as for Emulsion (2) of Example 1. The mean grain size and the amount of $Pb^{2+}$ doped as determined by atomic absorption spectroscopy are shown in Table 4.

TABLE 4

| Emulsion No. | Mean Grain Size (μm) | Amount of $Pb^{2+}$ Doped (mol/mol AgX) | Remark |
|---|---|---|---|
| (13) | 1.15 | Not detected | Comparison |
| (14) | 1.10 | $1 \times 10^{-6}$ | Comparison |
| (15) | 1.18 | $1.5 \times 10^{-4}$ | Invention |
| (16) | 1.10 | $4.5 \times 10^{-4}$ | Invention |

TABLE 4-continued

| Emulsion No. | Mean Grain Size (μm) | Amount of $Pb^{2+}$ Doped (mol/mol AgX) | Remark |
|---|---|---|---|
| (17) | 1.08 | $1.0 \times 10^{-3}$ | Invention |

Each of Emulsions (13) to (17) was heated to 35° C., and soluble salts were removed by adding an anionic polymer (e.g., a polystyrene sulfonic acid) using the sedimentation method. After the emulsion was again heated to 40° C., gelatin was added thereto. The emulsion was then adjusted so as to have a pH of 6.1 and a pAg of 8.6. After sampling for the test on the primitive emulsions hereinafter described, each of the emulsions was divided into small portions and subjected to sulfur sensitization at 60° C. for 60 minutes with a varied amount of sodium thiosulfate. To the sensitized emulsion were added 2,4-dichloro-6-hydroxy-s-triazine as a gelatin hardener and sodium dodecylbenzenesulfonate as a coating aid.

Separately, a 10 wt % gelatin aqueous solution containing the above-described coating aid was prepared as a coating composition for a protective layer.

The emulsion and the coating composition for a protective layer were coated in order on a triacetate film support to a silver coverage of 4.5 g/m² and a protective gelatin coverage of 1.0 g/m², respectively, followed by drying.

The thus prepared light-sensitive material was exposed to light through an optical wedge for sensitometry for 100 seconds, 1 second, or $10^{-3}$ second using a light source having a color temperature of 4,800° K. The exposed sample was subjected to development with a surface developer having the following formulation at 20° C. for 10 minutes, stopping, fixing, washing, and drying.

| Formulation of Developer: | |
|---|---|
| Metol | 5.5 g |
| L-Ascorbic Acid | 22 g |
| NABOX | 77 g |
| Potassium Bromide | 2.2 g |
| Water to make | 2,200 ml |

Table 5 shows photographic sensitivity of Samples 1 to 5 in which each of Emulsions (13) to (17) had been sulfur-sensitized under optimum conditions for 1 second exposure. The sensitivities were relatively expressed taking the sensitivity of Sample 1 exposed for 1 second as a standard (100).

TABLE 5

| Sample No. | Emulsion No. | Amount of $Pb^{2+}$ Doped (mol/mol AgX) | Photographic Sensitivity 100 (sec) | 1 (sec) | $10^{-3}$ (sec) |
|---|---|---|---|---|---|
| 1 (Comparison) | (13) | Not detected | 78 | 100 | 68 |
| 2 (Comparison) | (14) | $1 \times 10^{-6}$ | 96 | 120 | 80 |
| 3 (Invention) | (15) | $1.5 \times 10^{-4}$ | 160 | 200 | 180 |
| 4 (Invention) | (16) | $4.5 \times 10^{-4}$ | 220 | 230 | 210 |
| 5 (Invention) | (17) | $1.0 \times 10^{-3}$ | 200 | 210 | 160 |

Sample 1 showed low intensity reciprocity law failure and high intensity reciprocity law failure. Sample 2, in which a small amount of $Pb^{2+}$ has been doped, exhibited a slight improvement in sensitivity over Sample 1 but no substantial improvement with respect to reciprocity law failure. Samples 3 to 5, in which a large amount of $Pb^{2+}$ had been doped, showed a marked improvement in sensitivity over Sample 1, and greatly increased sensitivities for from 100 seconds to $10^{-3}$ second exposure, which indicate an appreciated improvement upon reciprocity law failure. As is apparent from these results, the technique of doping $1 \times 10^{-4}$ mol/mol AgX or more of a polyvalent metal ion according to the present invention is extremely effective to improve photographic sensitivity.

Samples 6 to 10 were prepared in the same manner as for Samples 1 to 5, except for using the corresponding primitive emulsion. Each of the samples was exposed for 1 second and processed with a Metolascorbic acid developer. The photographic sensitivities of the processed sample are shown in Table 6 below.

TABLE 6

| Sample No. | Emulsion No. | Chemical Sensitization | Sensitivity (1 second) |
|---|---|---|---|
| 6 | (13) | Primitive | 20 |
| 7 | (14) | Primitive | 20 |
| 8 | (15) | Primitive | 18 |
| 9 | (16) | Primitive | 16 |
| 10 | (17) | Primitive | 15 |

It can be seen from Table 6 that any of the primitive emulsions having doped therein a large amount of $Pb^{2+}$ showed no improvement, or rather were inferior in sensitivity to Sample 6 containing no $Pb^{2+}$. These results suggest that chemical sensitization plays an important role in manifestation of the effects of emulsions in which $1 \times 10^{-4}$ mol/mol AgX or more of a polyvalent metal ion has been doped.

EXAMPLE 5

A monodispersed emulsion of octahedral grains having a core-shell structure was prepared in the same manner as for Emulsion (10), except for using no $Pb(NO_3)_2$. This emulsion was designated as Emulsion (18). Gelatin was added to each of desalted Emulsions (10) and (18), and the emulsion was adjusted to a pH of 6.4 and a pAg of 8.8 at 40° C. Each of the emulsions was chemically sensitized with chloroauric acid and potassium thiocyanate under optimal conditions.

Samples 11 and 12 were prepared by coating each of the above-prepared emulsions and a protective layer on a triacetyl cellulose film support in accordance with the layer constitution shown below.

| Emulsion Layer: | |
|---|---|
| Emulsions (10) and (18) as prepared above | $2.1 \times 10^{-2}$ mol of Ag/m² |
| Coupler of formula: | $1.5 \times 10^{-3}$ mol/m² |

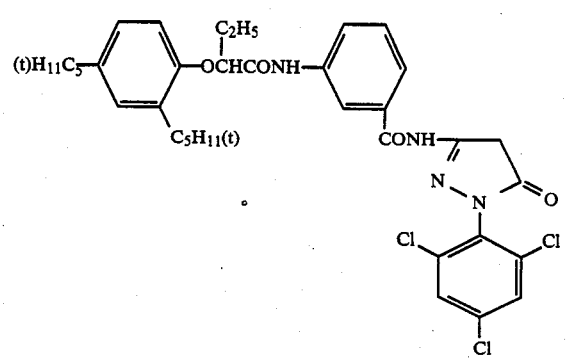

-continued

| | |
|---|---|
| Tricresyl phosphate | 1.10 g/m$^2$ |
| Gelatin | 2.30 g/m$^2$ |
| Protective Layer: | |
| Sodium 2,4-dichlorotriazine-6-hydroxy-s-triazine | 0.08 g/m$^2$ |
| Gelatin | 1.80 g/m$^2$ |

After each of Samples 11 and 12 was allowed to stand at 40° C. and 70 % RH for 14 hours, it was exposed to light for sensitometry and subjected to color development processing according to the following steps.

| | |
|---|---|
| 1. Color Development | 2 min 45 sec |
| 2. Bleaching | 6 min 30 sec |
| 3. Washing | 3 min 15 sec |
| 4. Fixing | 6 min 30 sec |
| 5. Washing | 3 min 15 sec |
| 6. Stabilization | 3 min 15 sec |

The processing solution used in each step had the following formulation.

| | |
|---|---|
| Formulation of Color Developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1,000 ml |
| Formulation of Bleaching Bath: | |
| Ammonium bromide | 160.0 g |
| Aqueous ammonia (28 wt %) | 25.0 ml |
| Sodium ethylenediaminetetraacetate | 130 g |
| Glacial acetic acid | 14 ml |
| Water to make | 1,000 ml |
| Formulation of Fixing Bath: | |
| Sodium tetrapolyphosphate | 2.0 g |
| Sodium sulfite | 4.0 g |
| Ammonium thiosulfate (70 wt %) | 175.0 ml |
| Sodium bisulfite | 4.6 g |
| Water to make | 1,000 ml |
| Formulation of Stabilizing Solution: | |
| Formalin (37 wt % formaldehyde soln.) | 8.0 ml |
| Water to make | 1,000 ml |

The thus processed samples were measured for density through a green filter. The results obtained are shown in Table 7.

TABLE 7

| Sample No. | Emulsion No. | Amount of $Pb^{2+}$ Doped (mol/mol AgX) | Sensitivity (1/100 sec) |
|---|---|---|---|
| 11 (Comparison) | (18) | Not detected | 100 |
| 12 (Invention) | (10) | $6.5 \times 10^{-4}$ | 170 |

As can be seen from Table 7, the technique of doping $1\times10^{-4}$ mol/mol AgX or more of a polyvalent metal ion according to the present invention is also particularly effective in the case where a highly sensitive silver iodobromide emulsion is subjected to color development.

EXAMPLE 6

A triacetyl cellulose film support having a subbing layer was coated with first to fourteenth layers according to the following layer constitution, in which Emulsion (10) or (18) which had been subjected to gold-sulfur sensitization was used, to prepare a multilayer color light-sensitive material (Samples 13 and 14, respectively).

| | |
|---|---|
| First Layer: Antihalation Layer | |
| Black colloidal silver | 0.2 g of Ag/m$^2$ |
| Gelatin | 1.3 g/m$^2$ |
| Colored Coupler (C-1) | 0.06 g/m$^2$ |
| Ultraviolet Absorbent (UV-1) | 0.1 g/m$^2$ |
| Ultraviolet Absorbent (UV-2) | 0.2 g/m$^2$ |
| Dispersing Oil (Oil-1) | 0.01 g/m$^2$ |
| Dispersing Oil (Oil-2) | 0.01 g/m$^2$ |
| Second Layer: Interlayer | |
| Fine Silver Bromide Grains (mean grain size: 0.07 μm) | 0.15 g of Ag/m$^2$ |
| Gelatin | 1.0 g/m$^2$ |
| Colored Coupler (C-2) | 0.02 g/m$^2$ |
| Dispersing oil (Oil-1) | 0.1 g/m$^2$ |
| Third Layer: | |
| First Red-Sensitive Emulsion Layer | |
| Silver Iodobromide Emulsion (silver iodide: 2 mol %, mean grain size: 0.3 μm) | 0.4 g of Ag/m$^2$ |
| Gelatin | 0.6 g/m$^2$ |
| Sensitizing Dye (I) | $1.0 \times 10^{-4}$ mol/mol AgX (X: halogen) |
| Sensitizing Dye (II) | $3.0 \times 10^{-4}$ mol/mol AgX |
| Sensitizing Dye (III) | $1 \times 10^{-5}$ mol/mol AgX |
| Coupler (C-3) | 0.06 g/m$^2$ |
| Coupler (C-4) | 0.06 g/m$^2$ |
| Coupler (C-8) | 0.04 g/m$^2$ |
| Coupler (C-2) | 0.03 g/m$^2$ |
| Dispersing Oil (Oil-1) | 0.03 g/m$^2$ |
| Dispersing Oil (Oil-3) | 0.012 g/m$^2$ |
| Fourth Layer: Second Red-Sensitive Emulsion Layer | |
| Silver Iodobromide Emulsion (silver iodide: 5 mol %, mean grain size: 0.5 μm) | 0.7 g of Ag/m$^2$ |
| Sensitizing Dye (I) | $1 \times 10^{-4}$ mol/mol AgX |
| Sensitizing Dye (II) | $3 \times 10^{-4}$ mol/mol AgX |
| Sensitizing Dye (III) | $1 \times 10^{-5}$ mol/mol AgX |
| Coupler (C-3) | 0.24 g/m$^2$ |
| Coupler (C-4) | 0.24 g/m$^2$ |
| Coupler (C-8) | 0.04 g/m$^2$ |
| Coupler (C-2) | 0.04 g/m$^2$ |
| Dispersing Oil (Oil-1) | 0.15 g/m$^2$ |
| Dispersing Oil (Oil-3) | 0.02 g/m$^2$ |
| Fifth Layer: Third Red-Sensitive Emulsion Layer | |
| Emulsion (10) or (18) | 1.0 g of Ag/m$^2$ |
| Gelatin | 1.0 g/m$^2$ |
| Sensitizing Dye (I) | $1 \times 10^{-4}$ mol/mol AgX |
| Sensitizing Dye (II) | $3 \times 10^{-4}$ mol/mol AgX |
| Sensitizing Dye (III) | $1 \times 10^{-5}$ mol/mol AgX |
| Coupler (C-6) | 0.05 g/m$^2$ |
| Coupler (C-7) | 0.1 g/m$^2$ |
| Dispersing Oil (Oil-1) | 0.01 g/m$^2$ |
| Dispersing Oil (Oil-2) | 0.05 g/m$^2$ |
| Sixth Layer: Interlayer | |
| Gelatin | 1.0 g/m$^2$ |
| Compound (Cpd-A) | 0.03 g/m$^2$ |
| Dispersing Oil (Oil-1) | 0.05 g/m$^2$ |
| Seventh Layer: First Green-Sensitive Emulsion Layer | |
| Silver Iodobromide Emulsion (silver iodide: 4 mol %, mean grain size: 0.3 μm) | 0.30 g of Ag/m$^2$ |
| Sensitizing Dye (IV) | $5 \times 10^{-4}$ mol/mol AgX |
| Sensitizing Dye (V) | $2 \times 10^{-4}$ mol/mol AgX |
| Sensitizing Dye (VI) | $3.0 \times 10^{-4}$ mol/mol AgX |
| Gelatin | 1.0 g/m$^2$ |
| Coupler (C-9) | 0.2 g/m$^2$ |
| Coupler (C-5) | 0.03 g/m$^2$ |
| Coupler (C-1) | 0.03 g/m$^2$ |
| Dispersing Oil (Oil-1) | 0.5 g/m$^2$ |
| Eighth Layer: Second Green-Sensitive Emulsion Layer | |
| Silver Iodobromide Emulsion (silver iodide: 5 mol %, mean grain | 0.4 g of Ag/m$^2$ |

-continued

| | |
|---|---|
| size: 0.5 μm) | |
| Sensitizing Dye (IV) | $5 \times 10^{-4}$ mol/mol AgX |
| Sensitizing Dye (V) | $2 \times 10^{-4}$ mol/mol AgX |
| Sensitizing Dye (VI) | $3.0 \times 10^{-4}$ mol/mol AgX |
| Coupler (C-9) | 0.25 g/m$^2$ |
| Coupler (C-1) | 0.03 g/m$^2$ |
| Coupler (C-10) | 0.015 g/m$^2$ |
| Coupler (C-5) | 0.01 g/m$^2$ |
| Dispersing Oil (Oil-1) | 0.2 g/m$^2$ |
| Ninth Layer: Third Green-Sensitive Emulsion Layer | |
| Emulsion (10) or (18) | 0.85 g of Ag/m$^2$ |
| Gelatin | 1.0 g/m$^2$ |
| Sensitizing Dye (VII) | $3.5 \times 10^{-4}$ mol/mol AgX |
| Sensitizing Dye (VIII) | $1.4 \times 10^{-4}$ mol/mol AgX |
| Coupler (C-11) | 0.01 g/m$^2$ |
| Coupler (C-12) | 0.03 g/m$^2$ |
| Coupler (C-13) | 0.20 g/m$^2$ |
| Coupler (C-1) | 0.02 g/m$^2$ |
| Coupler (C-15) | 0.02 g/m$^2$ |
| Dispersing Oil (Oil-1) | 0.20 g/m$^2$ |
| Dispersing Oil (Oil-2) | 0.05 g/m$^2$ |
| Tenth Layer: Yellow Filter Layer | |
| Gelatin | 1.2 g/m$^2$ |
| Yellow Colloidal Silver | 0.08 g/m$^2$ |
| Compound (Cpd-B) | 0.1 g/m$^2$ |
| Dispersing Oil (Oil-1) | 0.3 g/m$^2$ |
| Eleventh Layer: First Blue-Sensitive Emulsion Layer | |
| Monodispersed Silver Iodobromide Emulsion (silver iodide: 4 mol %, mean grain size: 0.3 μm) | 0.4 g of Ag/m$^2$ |
| Gelatin | 1.0 g/m$^2$ |

-continued

| | |
|---|---|
| Sensitizing Dye (IX) | $2 \times 10^{-4}$ mol/mol AgX |
| Coupler (C-14) | 0.9 g/m$^2$ |
| Coupler (C-5) | 0.07 g/m$^2$ |
| Dispersing Oil (Oil-1) | 0.2 g/m$^2$ |
| Twelfth Layer: Second Blue-Sensitive Emulsion Layer | |
| Emulsion (10) or (18) | 0.5 g of Ag/m$^2$ |
| Gelatin | 0.6 g/m$^2$ |
| Sensitizing Dye (IX) | $1 \times 10^{-4}$ mol/mol AgX |
| Coupler (C-14) | 0.25 g/m$^2$ |
| Dispersing Oil (Oil-1) | 0.07 g/m$^2$ |
| Thirteenth Layer: First Protective Layer | |
| Gelatin | 0.8 g/m$^2$ |
| Ultraviolet Absorbent (UV-1) | 0.1 g/m$^2$ |
| Ultraviolet Absorbent (UV-2) | 0.2 g/m$^2$ |
| Dispersing Oil (Oil-1) | 0.01 g/m$^2$ |
| Dispersing Oil (Oil-2) | 0.01 g/m$^2$ |
| Fourteenth Layer: Second Protective Layer | |
| Fine Silver Bromide Grains (mean grain size: 0.07 μm) | 0.5 g of Ag/m$^2$ |
| Gelatin | 0.45 g/m$^2$ |
| Polymethyl Methacrylate Particles (diameter: 1.5 μm) | 0.2 g/m$^2$ |
| Hardener (H-1) | 0.4 g/m$^2$ |
| Formaldehyde Scavenger (S-1) | 0.5 g/m$^2$ |
| Formaldehyde Scavenger (S-2) | 0.5 g/m$^2$ |

Each of the above layers further contained a surface active agent as a coating aid.

The compounds used in the sample preparation are as follows:

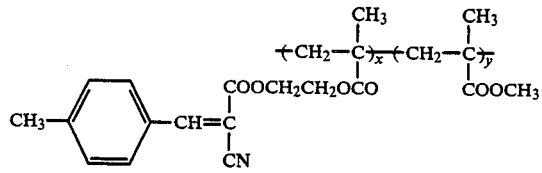

x/y = 7/3 (by weight) UV-1

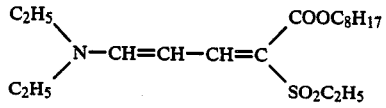

UV-2

Tricresyl Phosphate Oil-1

Dibutyl Phthalate Oil-2

Bis(2-ethylhexyl) Phthalate Oil-3

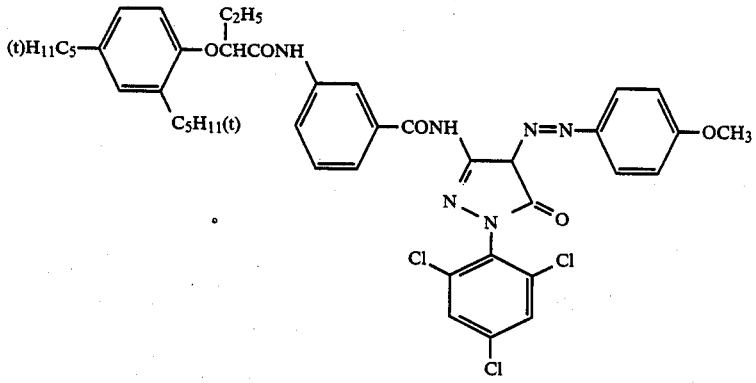

C-1

-continued
C-2
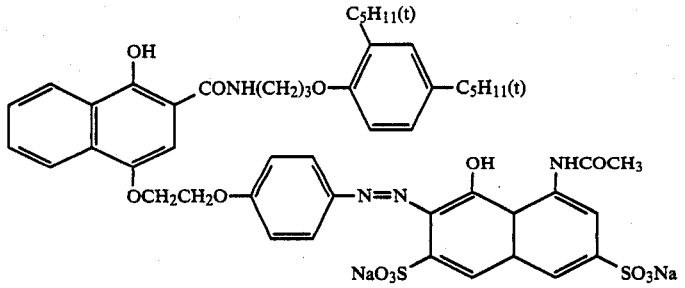
C-3
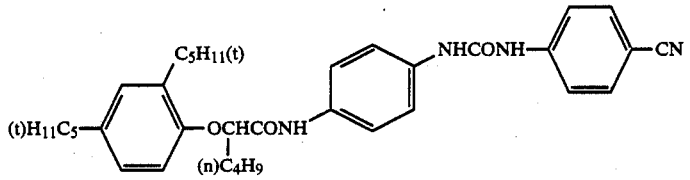
C-4
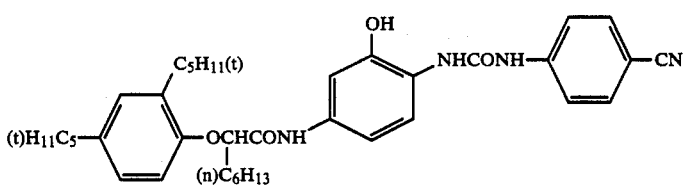
C-5
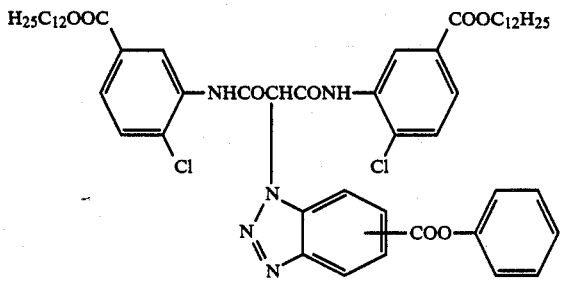
C-6
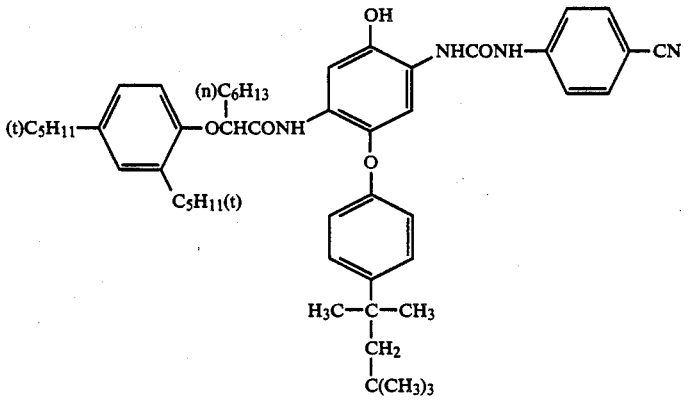
C-7
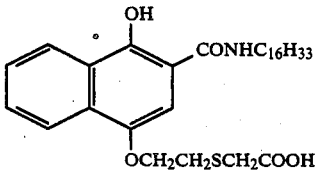

-continued
C-8
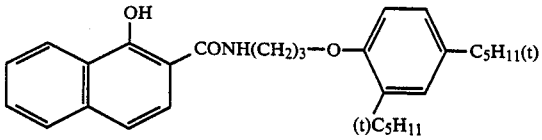
C-9
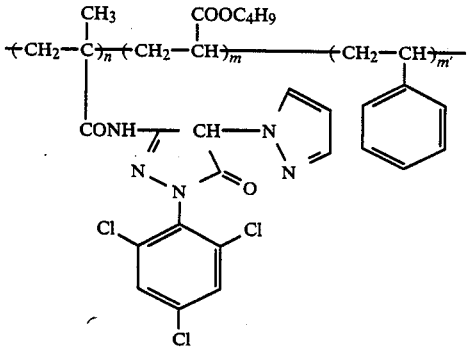
n = 50
m = 25
m' = 25
molecular weight: about 20,000
C-10
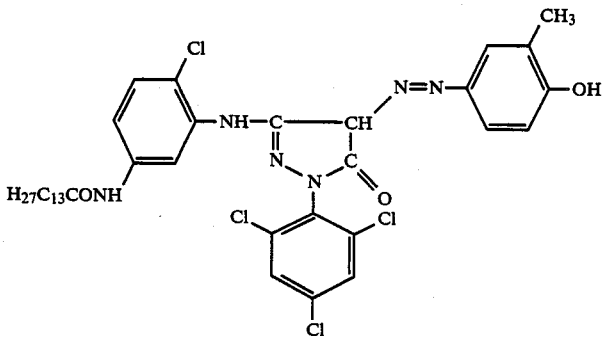
C-11
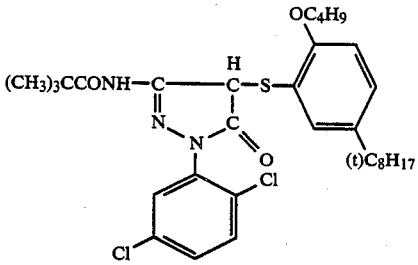
C-12
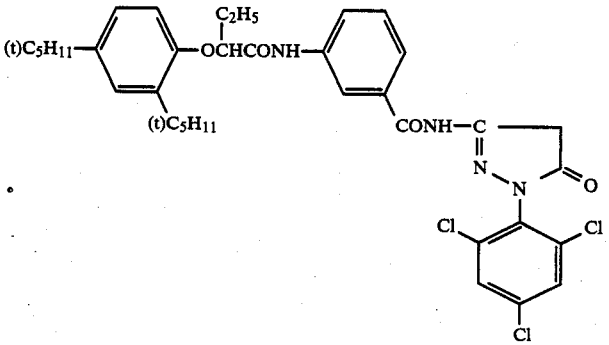

-continued
C-13
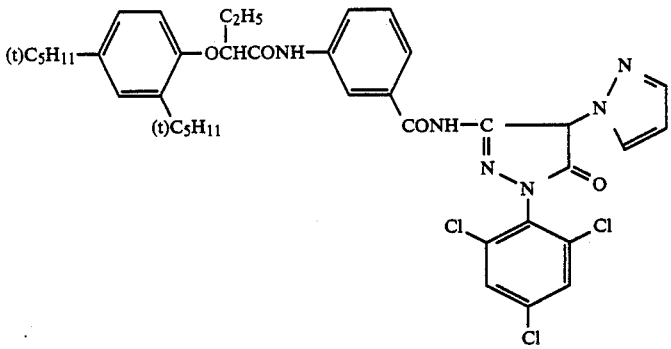
C-14
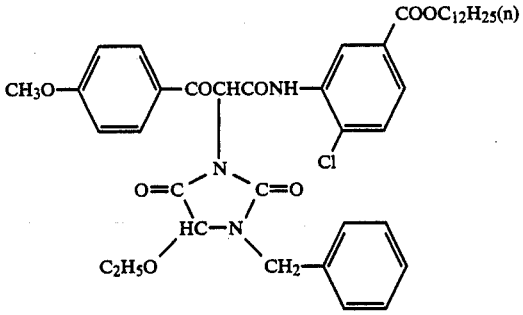
C-15
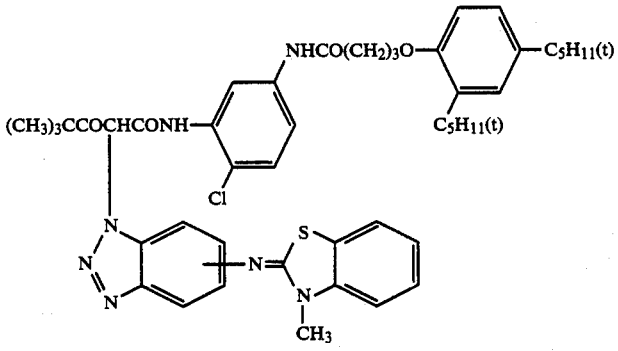
Cpd-A
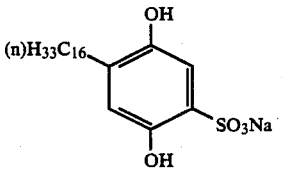
Cpd-B
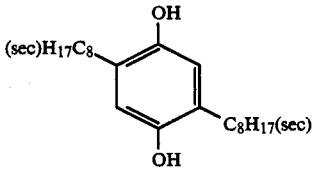
Sensitizing Dye I
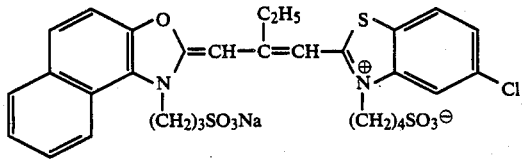

-continued
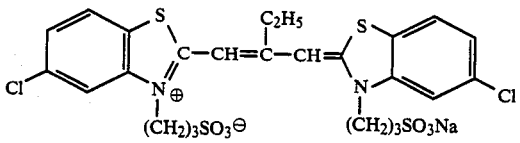
Sensitizing Dye II
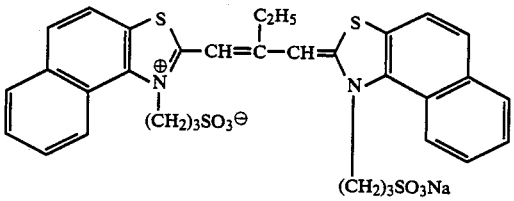
Sensitizing Dye III
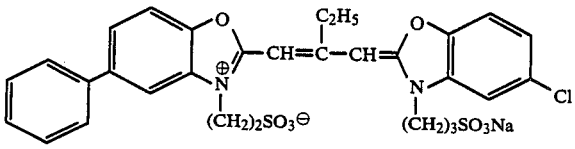
Sensitizing Dye IV
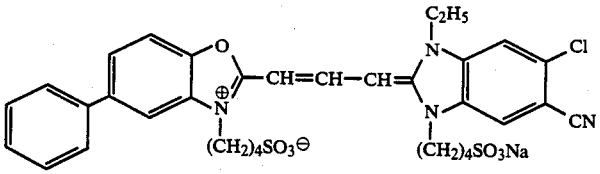
Sensitizing Dye V
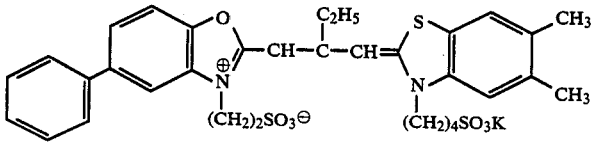
Sensitizing Dye VI
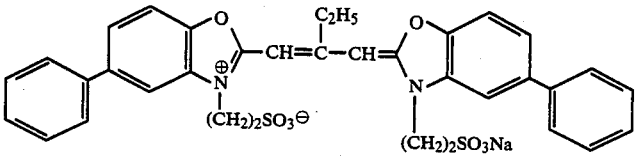
Sensitizing Dye VII
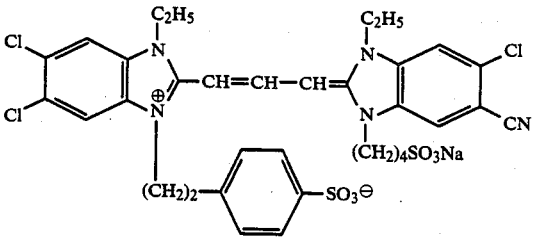
Sensitizing Dye VIII
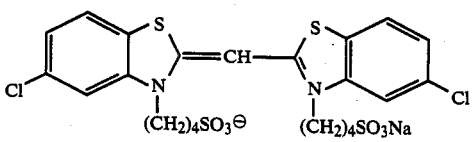
Sensitizing Dye IX
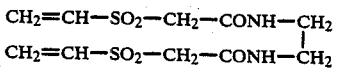
H-1

-continued

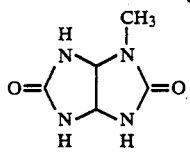

S-1

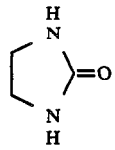

S-2

Each of Samples 13 and 14 was exposed to light emitted from a tungsten lamp (color temperature: 4,800° K.) through a filter at 25 CMS, and the exposed sample was subjected to development processing according to the following procedure:

| | |
|---|---|
| Color Development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 05 sec |

Each of the processing solutions used had the following formulation:

| | |
|---|---|
| Color Development Formulation: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1,000 ml |
| | pH: 10.0 |
| Bleaching Bath Formulation: | |
| Ammonium (Ethylenediaminetetraacetato)-Ferrite | 100.0 g |
| Disodium Ethylenediaminetetraacetate | 10.0 g |
| Ammonium Bromide | 150.0 g |
| Ammonium Nitrate | 10.0 g |
| Water to make | 1,000 ml |
| | pH: 6.0 |
| Fixing Bath Formulation: | |
| Disodium Ethylenediaminetetraacetate | 1.0 g |
| Sodium Sulfite | 4.0 g |
| Ammonium Thiosulfate Aqueous Solution (70 wt %) | 175.0 ml |
| Sodium Bisulfite | 4.6 g |
| Water to make | 1,000 ml |
| Stabilizing Solution: | |
| Formalin (40 wt % formaldehyde soln.) | 2.0 ml |
| Polyoxyethylene-p-monononyl Phenyl Ether (average degree of polymerization: 10) | 0.3 g |
| Water to make | 1,000 ml |

As a result of evaluations, it was found that Sample 13 using Emulsion (10) according to the present invention had increased sensitivity and improved reciprocity law characteristics over Sample 14 using Emulsion (18). This example demonstrates that the technique of doping $1\times10^{-4}$ mol/mol AgX or more of a polyvalent metal ion is also very effective in multilayer color light-sensitive materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one photographic silver halide emulsion layer containing silver halide grains dispersed in a dispersing medium, wherein in said silver halide grains, a total weight of the portion where at least one polyvalent metal ion is doped in an amount of not less than $1\times10^{-4}$ mol per mol of the doped silver halide, is at least 10% based on the total weight of said silver halide grains, wherein said at least one polyvalent metal ion is selected from divalent metal ions.

2. A silver halide photographic material as in claim 1, wherein said at least one polyvalent metal ion is selected from those other than platinum group metal ions.

3. A silver halide photographic material as in claim 1, wherein said at least one polyvalent metal ion is selected from $Pb^{2+}$, $Fe^{2+}$, and $Cd^{2+}$.

4. A silver halide photographic material as in claim 1, wherein said at least one polyvalent metal ion is $Pb^{2+}$.

5. A silver halide photographic material as in claim 1, wherein in said silver halide grains, a total weight of the portion where at least one polyvalent metal ion is doped in an amount of not less than $1\times10^{-4}$ mol per mol of the doped silver halide, is at least 30% based on the total weight of said silver halide grains.

6. A silver halide photographic material as in claim 5, wherein the total weight of the portion is at least 50% based on the total weight of said silver halide grains.

7. A silver halide photographic material as in claim 1, wherein in said silver halide grains, a total weight of the portion where at least one polyvalent metal ion is doped in an amount of not less than $2\times10^{-4}$ mol per mol of the doped silver halide, is at least 10% based on the total weight of said silver halide grains.

8. A silver halide photographic material as in claim 1, wherein in said silver halide grains, a total weight of the portion where at least one polyvalent metal ion is doped in an amount of not less than $3\times10^{-4}$ mol per mol of the doped silver halide, is at least 10% based on the total weight of said silver halide grains.

9. A silver halide photographic material as in claim 8, wherein the total weight of the portion is at least 30% based on the total weight of said silver halide grains.

10. A silver halide photographic material as in claim 1, wherein said silver halide grains are subjected to chemical sensitization.

11. A silver halide photographic material as in claim 10, wherein said silver halide grains are subjected to sulfur sensitization or gold sensitization.

12. A silver halide photographic material as in claim 1, wherein said silver halide grains are formed by increasing the amount of a water-soluble silver salt aqueous solution and an alkali halide aqueous solution.

13. A silver halide photographic material as in claim 1, wherein said silver halide grains are formed in the presence of ammonia, thiourea compounds or thioether compounds.

* * * * *